US008955190B2

(12) United States Patent
Ivory

(10) Patent No.: US 8,955,190 B2
(45) Date of Patent: Feb. 17, 2015

(54) COMBINED SELF-CLEANING TOOTHBRUSH AND TONGUE SCRAPER

(71) Applicant: Brian Ivory, Boardman, OH (US)

(72) Inventor: Brian Ivory, Boardman, OH (US)

( * ) Notice: Subject to any disclaimer, the term of this patent is extended or adjusted under 35 U.S.C. 154(b) by 0 days.

(21) Appl. No.: 14/244,171

(22) Filed: Apr. 3, 2014

(65) Prior Publication Data

US 2014/0298605 A1 Oct. 9, 2014

Related U.S. Application Data

(60) Provisional application No. 61/808,694, filed on Apr. 5, 2013.

(51) Int. Cl.
*A46B 9/04* (2006.01)
*A46B 15/00* (2006.01)

(52) U.S. Cl.
CPC ..... *A46B 15/0081* (2013.01); *A46B 9/04* (2013.01); *A46B 2200/1066* (2013.01)
USPC ..... 15/167.1; 15/111; 15/205.2

(58) Field of Classification Search
CPC ..... A46B 9/04
USPC ..... 15/167.1, 205.2, 111
See application file for complete search history.

(56) References Cited

U.S. PATENT DOCUMENTS

| | | | | |
|---|---|---|---|---|
| 1,797,946 | A * | 3/1931 | Eichel | 401/184 |
| 2,438,268 | A | 3/1948 | Bressler | |
| 2,582,552 | A * | 1/1952 | Marco | 15/167.1 |
| D282,318 | S | 1/1986 | Herzfeld | |
| D283,952 | S | 5/1986 | Berkowitz | |
| D377,417 | S | 1/1997 | Gupta | |
| 5,758,380 | A | 6/1998 | Vrignaud | |
| 5,836,036 | A * | 11/1998 | Ivory | 15/167.1 |
| 5,842,247 | A | 12/1998 | Decesare | |
| 6,085,379 | A * | 7/2000 | Stafford | 15/167.1 |
| 6,273,719 | B1 | 8/2001 | Whitman | |

* cited by examiner

*Primary Examiner* — Randall Chin
(74) *Attorney, Agent, or Firm* — Harpman & Harpman

(57) ABSTRACT

A toothbrush with improved cleaning after use and integral tongue cleaning features. Multiple groups of brush bristles are positioned around a plurality of cleaning openings that extend through the head of the brush head. Multiple upstanding tongue engagement surfaces are positioned in parallel spaced relation to one another between the flow through cleaning openings for selective engagement on the surface of the user's tongue.

1 Claim, 4 Drawing Sheets

COMBINED SELF-CLEANING TOOTHBRUSH AND TONGUE SCRAPER

This application claims the benefit of U.S. Provisional Application No. 61/808,694, filed Apr. 5, 2013

BACKGROUND OF THE INVENTION

1. Technical Field

This invention relates to toothbrushes that are used to clean the teeth of humans by repetitive scrubbing of the teeth and tongue scrapers that are used to scrap the upper surface of a human's tongue for increased oral hygiene.

2. Description of Prior Art

Prior art devices of this type are directed towards toothbrushes and tongue scrapers that have improved cleaning operation to allow for better brush cleaning and improved performance during use, see for example U.S. Pat. No. 2,438,268 and D282,318 for toothbrush configurations.

U.S. Pat. No. 2,438,268 is directed to a flexible bristle head toothbrush wherein a plurality of independent brush bristle support sections are secured together in parallel spaced relation to one another by a flexible connector element that extends through oppositely disposed portions of each section and attaches to a handle.

In Design patent D282,318 a toothbrush head design is disclosed wherein a brush head has a single large opening therein surrounded by a plurality of bristles extending therefrom.

Examples of prior art patents having combined brush and tongue scraping elements can be seen in U.S. Pat. Nos. 5,758,380, 5,842,247, 6,273,719, D283,952 and D377,417.

In U.S. Pat. No. 5,758,380 a toothbrush is disclosed having a U-shaped scraper on the back of a bristle brush head.

In U.S. Pat. No. 5,842,247 a tongue cleaning brush with a toothbrush is shown.

In Pat. No. 6,273,719 an oral hygiene implement is illustrating having a brush on one end and a loop on the other end which acts as a tongue scraper.

In Design patent 283,952 a combined toothbrush and tongue scraper is illustrated and in Design patent 377,417 a toothbrush is shown on one end of a handle and a tongue scraper on the other.

Applicant's own U.S. Pat. No. 5,836,036 discloses a self-cleaning toothbrush on which the present invention is an improvement with the addition of an integral tongue scraper and improved bristle position and cleaning element pass through configurations.

SUMMARY OF THE INVENTION

A combination of a self-cleaning toothbrush and integral tongue scraper that has a plurality of brush bristle groups that are mounted in spaced relation to one another with multiple pass through cleaning openings therebetween.

A plurality of upstanding tongue scraper elements extend from the opposite side of the brush head adjacent the selected cleaning openings.

DETAILED DESCRIPTION OF THE INVENTION

Figure 2:
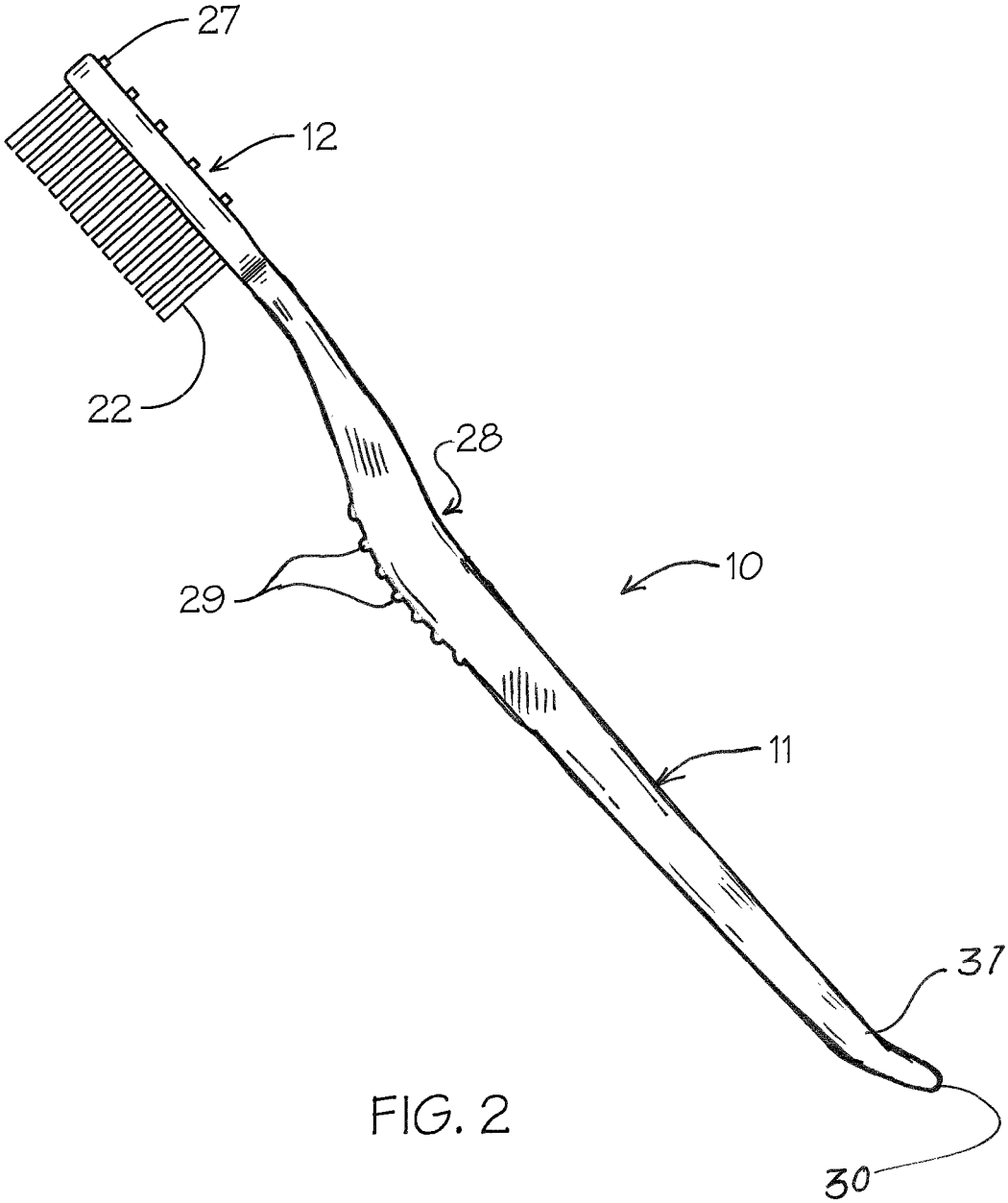
FIG. 2 is a side elevational view of the toothbrush of the invention.

Referring to FIG. 2 of the drawings, a self-cleaning tongue scraper toothbrush 10 can be seen having a handle portion 11 and a brush head portion 12 with a plurality of bristles 22 so indicated extending therefrom.

Figure 1:
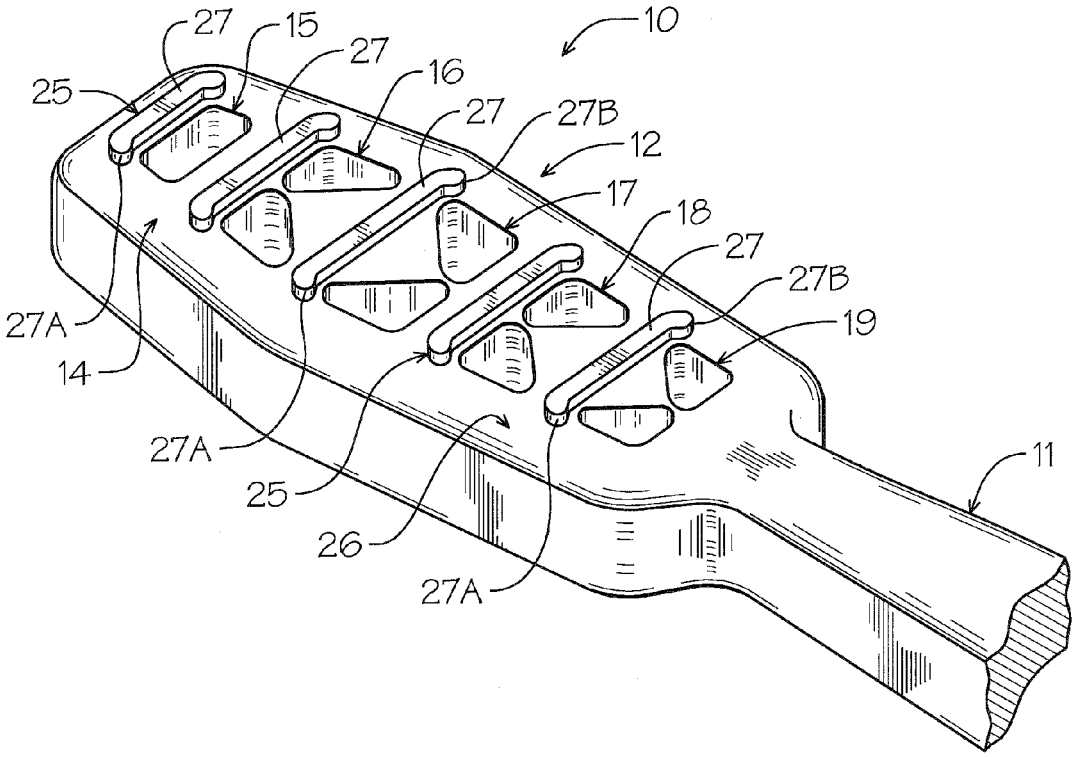
FIG. 1 is an enlarged partial perspective view of the brush head portion of the invention.
Figure 3:
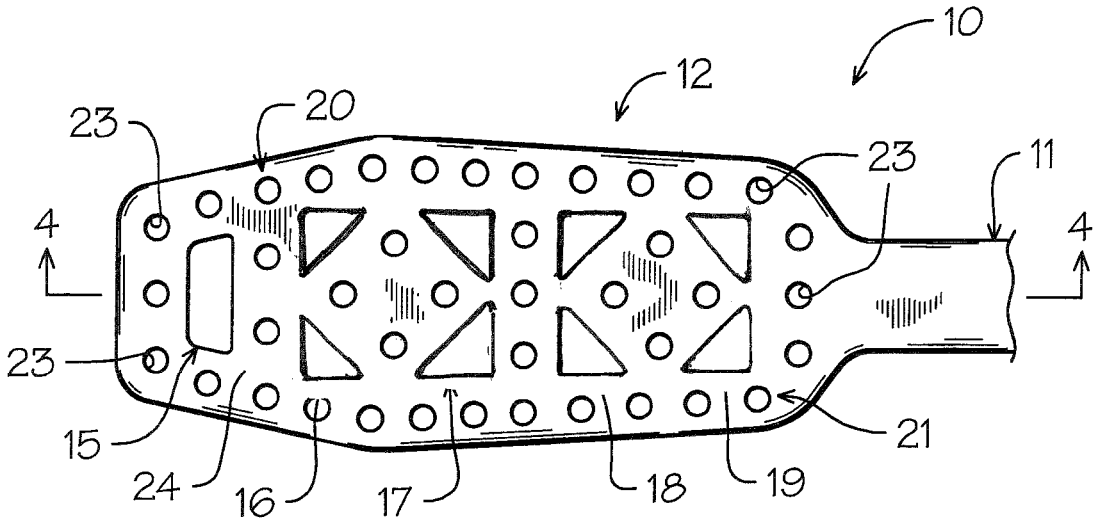
FIG. 3 is an enlarged bottom plan view of the brush head portion of the invention.
Figure 4:
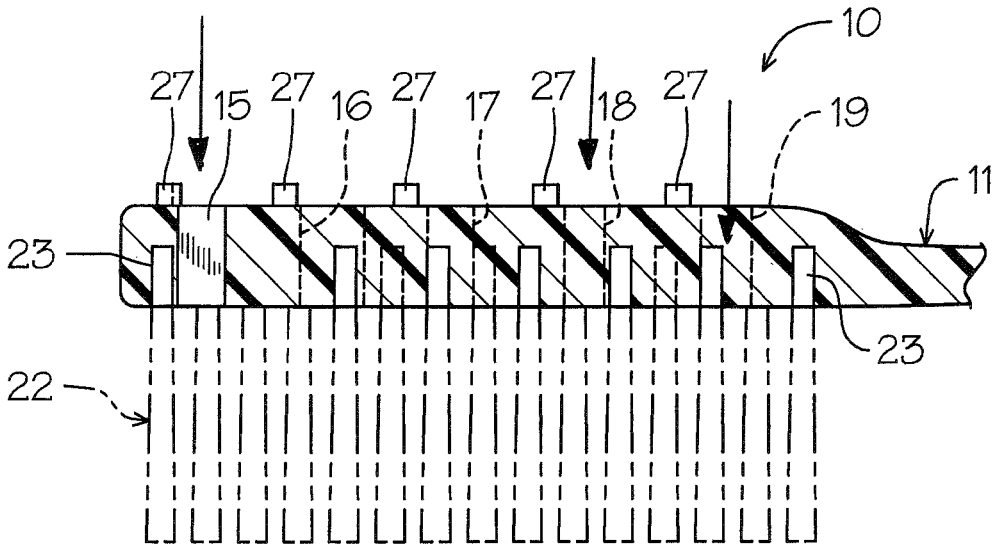
FIG. 4 is an enlarged partial sectional view on lines 4-4 of FIG. 3.
Figure 5:
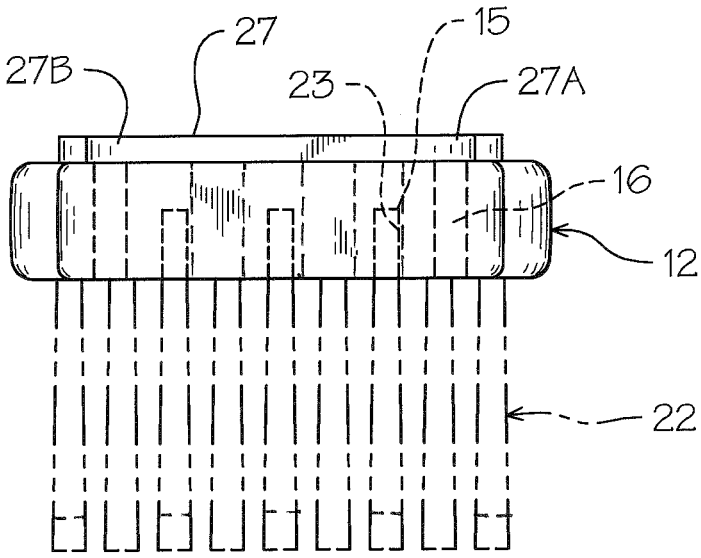
FIG. 5 is an end elevational view of the brush head portion of the toothbrush with bristles shown in broken lines extending therefrom.

The brush head portion 12, as best seen in FIGS. 1, 3 and 4 of the drawings, has an outer perimeter support portion 14 that defines a generally rectangular shape thereof. A series of bristle mounting areas are defined within the brush head by multiple groups of aligned shaped cleaning openings 15, 16, 17, 18 and 19 therethrough. The bristle mounting areas are arranged in transverse and longitudinal patterns 20 and 21, as best seen in FIG. 3 of the drawings. A plurality of evenly spaced brush bristle bundles 22 shown in broken lines in FIGS. 4 and 5 of the drawings extend from corresponding mounting sockets 23 within the hereinbefore described transverse and longitudinal mounting patterns 20 and 21 on a brush head surface 24 surrounding the cleaning openings 15-19.

Each of the bristle retaining sockets 23 are of equal annular dimension and depth and are evenly spaced with respect to one another within the bristle mounting areas in the surface 24 of the brush head portion 12 as seen in FIG. 3 of the drawings.

The brush bristle bundles 22 so defined in their respective groups extending from the respective mounting sockets 23 may be of even or uneven length to provide an effective brushing pattern during use as will be well understood by those skilled in the art.

The open pass through nature of the brush head portion 12 imparted by the multiple cleaning openings 15-19 therethrough are adjacent the brush head bundle groups 22 assure the effective cleaning after use by creating an enhanced flow action of tap water as it passed therethrough indicated by directional flow arrows in FIG. 4 of the drawings, for example.

Referring now to FIGS. 1, 2 and 4 of the drawings, a plurality of upstanding tongue scraper elements 25 extend from brush head's top surface area 26 in oppositely disposed relation of the bristle bundles 22 as previously described. Each of the scraper elements 25 is comprised of an elongated bar portion 27 in spaced parallel relation to one another having oppositely disposed enlarged contoured ends 27A and 27B. Each of the hereinbefore described scraper elements 25 extend transversely across the brush head's top surface 26 and are positioned adjacent the respective pass through cleaning openings 15-19 to provide ease of cleaning after each use.

The handle portion 11 of the toothbrush 10 of the invention is curved at 28 extending from the brush head portion 12 with a plurality of grip enhancement bands 29 thereon. The remaining handle portion at 29 is longitudinally tapered towards its free end at 30 which is angularly offset at 31.

It will be evident from the above description that a user (not shown) will have the advantage of a high performance toothbrush with self-cleaning action due to the cleaning openings 15-19. Additionally, the multiple tongue scraper elements 25 will enhance the oral hygiene effectiveness of the brush 10 by providing an integral tooth scraper which will allow for ease of use and cleaning as hereinbefore described.

It will thus be seen that a new and novel combination self-cleaning toothbrush and tongue scraper has been illustrated and described and it will be apparent to those skilled in the art that various changes and modifications may be made thereto without departing from the spirit of the invention.

I claim:

1. A toothbrush having a handle portion and a brush head portion, said brush head portion comprising, a plurality of grouped aligned cleaning openings through said brush head defining multiple toothbrush bristle support areas therebetween, toothbrush bristles extending in bundles from multiple spaced mounting sockets within said toothbrush bristle support areas extending transversely adjacent said grouped cleaning openings, a plurality of upstanding elongating tongue scraping elements extending transversely from said brush head in oppositely disposed relation to said toothbrush bristle bundles, said tongue scraping elements have oppositely disposed end arms of increased dimensional aspect extending toward said adjacent cleaning openings, said handle portion extending from said brush head portion in longitudinal alignment therewith.

* * * * *